US007118354B2

(12) United States Patent
Kenney et al.

(10) Patent No.: US 7,118,354 B2
(45) Date of Patent: Oct. 10, 2006

(54) SYSTEM AND METHOD FOR IMPROVING PETROLEUM DISPENSING STATION DISPENSING FLOW RATES AND DISPENSING CAPACITY

(75) Inventors: Donald P. Kenney, McFarland, WI (US); Donald A. Gibson, Stoughton, WI (US); Randy E. Craig, Brooklyn, WI (US)

(73) Assignee: Fe Petro, Inc., McFarland, WI (US)

( * ) Notice: Subject to any disclaimer, the term of this patent is extended or adjusted under 35 U.S.C. 154(b) by 286 days.

(21) Appl. No.: 10/023,284

(22) Filed: Dec. 15, 2001

(65) Prior Publication Data

US 2003/0113219 A1 Jun. 19, 2003

(51) Int. Cl.
*F04B 17/03* (2006.01)

(52) U.S. Cl. ..... 417/366; 417/423.3

(58) Field of Classification Search ..... 417/366, 417/423.3, 423.14

See application file for complete search history.

(56) References Cited

U.S. PATENT DOCUMENTS

| | | | | |
|---|---|---|---|---|
| 2,043,283 | A | | 6/1936 | Conant |
| 3,126,831 | A | | 3/1964 | Deters |
| 3,135,212 | A | | 6/1964 | Todd et al. |
| 3,318,249 | A | | 5/1967 | Loeser |
| 3,387,564 | A | | 6/1968 | De Lancey |
| 3,398,687 | A | | 8/1968 | Yoshikawa |
| 3,716,309 | A | | 2/1973 | Mitchell |
| 3,775,024 | A | | 11/1973 | Ulm et al. |
| 4,013,383 | A | | 3/1977 | Rule |
| 4,500,263 | A | | 2/1985 | Mohn |
| 4,541,782 | A | | 9/1985 | Mohn |
| 4,571,159 | A | * | 2/1986 | Beardmore ..... 417/366 |
| 4,834,623 | A | * | 5/1989 | Triolo et al. ..... 417/366 |
| 4,948,348 | A | | 8/1990 | Doll et al. |
| 4,966,532 | A | | 10/1990 | Fengsheng |
| 5,055,006 | A | | 10/1991 | Kobayashi et al. |
| 5,567,133 | A | | 10/1996 | Kobaybashi et al. |
| 5,593,287 | A | * | 1/1997 | Sadakata et al. ..... 417/366 |
| 5,673,732 | A | * | 10/1997 | Kenney et al. ..... 141/59 |
| 6,000,917 | A | * | 12/1999 | Smerud et al. ..... 417/366 |
| 6,070,760 | A | | 6/2000 | Kenney et al. |
| 6,109,893 | A | * | 8/2000 | Gliniecki et al. ..... 417/423.3 |
| 6,126,416 | A | | 10/2000 | Lee |
| 6,739,844 | B1 | * | 5/2004 | Yu et al. ..... 417/366 |

FOREIGN PATENT DOCUMENTS

| | | |
|---|---|---|
| CH | 207150 | 12/1939 |
| DE | 880548 | 6/1953 |

* cited by examiner

*Primary Examiner*—Michael Koczo, Jr.
(74) *Attorney, Agent, or Firm*—Katten Muchin Rosenman LLP; John S. Paniaguas

(57) ABSTRACT

A submersible pump-motor assembly for use in dispensing petroleum from petroleum storage tanks. The pump-motor assembly of the present invention enhances the performance characteristics of the pump-motor assembly by providing greater flow area around the motor stator while maintaining the alignment of the assembly's critical pump components. Such enhanced pump performance characteristics provide the petroleum dispensing station manager using such pump-motor assemblies with greater flow rates per dispenser or, when maximum flow rates are capped, potentially greater dispensing capacity.

11 Claims, 6 Drawing Sheets

SYSTEM AND METHOD FOR IMPROVING PETROLEUM DISPENSING STATION DISPENSING FLOW RATES AND DISPENSING CAPACITY

BACKGROUND OF THE INVENTION

Description of the Prior Art

Referring to FIG. 1, in petroleum dispensing stations, submersible turbine pump-motor assemblies 10 are disposed in petroleum storage tanks 12 and are used to pump petroleum 14 from the storage tank 12, which is usually located underground, to dispensers 16. (In FIG. 1 only one dispenser 16 is depicted, but it should be understood that in a typical petroleum dispensing station a single pump-motor assembly 10 provides fuel to a number of dispensers 16.) Customers dispense fuel from a dispenser 16 into their vehicles through a nozzle 18. The typical pump-motor assembly 10 includes a turbine or centrifugal pump and an electric motor which drives the pump. The upper end of the pump-motor assembly 10 attaches to a piping assembly 22 which connects to a manifold assembly 24 which, in turn, connects to a piping network 26 to distribute petroleum from the pump-motor assembly 10 to the dispensers 16 attached to the piping network 26.

Petroleum dispensing station managers, service station owners for instance, ideally want to maximize the dispensing flow rate possible for each available dispenser to increase the total potential throughput through the station. For certain petroleum products, however, the maximum dispensing flow rate per dispenser is set by government regulation, and the station manager has no incentive to achieve greater flow rates. For instance, in the U.S., the government (i.e., the E.P.A) has set an upper limit of 10 gallons/minute ("GPM") as the maximum flow rate per dispenser for certain petroleum products such as gasoline. In such cases, the petroleum dispensing station manager seeks to achieve the alternate goal of maximizing the dispensing capacity for each piping network 26. In other words, station managers in such cases want to maximize the number of dispensers 16 operating at the maximum flow rate and pressure for a single pump-motor assembly. The present problem with maximizing dispensing flow rates and dispensing capacity is that dispensing flow rates and dispensing capacity are limited by the flow rates achieved by present system pump-motor assemblies at a given required pressure. Much of the flow rate limitations of present pump-motor assemblies are attributable to their design.

In present pump-motor assemblies, it is critical that the components of the pump assembly align with the motor's drive shaft; otherwise, vibration and other misalignment forces will affect the proper performance of the pump and may eventually cause the pump to fail. Referring to FIG. 2, a pump-motor assembly 10 presently used by petroleum dispensing stations is depicted. The pump-motor assembly 10 includes a motor unit 30 and a pump assembly 32. A shell 20 encases the motor unit 30 and the pump assembly components. The shell 20 performs the critical function of holding the pump assembly components in alignment with the shaft 36 of the motor unit 30. The shell 20 is formed with an inner diameter that is relatively equal to the greatest outer diameter of the motor unit 30. The motor unit 30 typically includes an end bell 33, a stator 31 and a lead housing 35. The end bell 33 and the lead housing 35 have contact points 38, 39, respectively, extending therefrom. The contact points 38, 39 have the greatest outer diameter of the motor unit 30.

As such, when the pump-motor assembly 10 is assembled, the shell 20 contacts the motor unit 30 at the contact points 38, 39. The contact between the shell 20 and the contact points 38, 39 keeps the motor 30 and shell 20 in alignment. The shell 20 also contacts components of the pump assembly 32. Specifically, in the pump-motor assembly 10 depicted in FIG. 2, the shell 20 contacts housings 40 and diffusers 42 of the pump assembly 32. The contact between the shell 20 and the pump-assembly components performs the critical function of keeping the pump assembly components in alignment with the motor shaft 36. In addition to the pump-motor assembly 10 depicted in FIG. 2, other similar pump-motor assemblies are available on the market. Such other pump-motor assemblies might have somewhat different component configurations than the pump-motor assembly 10 depicted (i.e., the pump housing and diffuser components may be integral in some form with one another rather separate as in the pump-motor assembly 10 depicted), but they still employ the principles discussed above (e.g., use of the shell for alignment purposes).

In addition to the alignment interaction, the shell 20 and the motor unit 30 also form a flow path 34 between the shell 20 and the stator 31. Petroleum pumped up through the pump-motor assembly 10 to the piping assembly 22 is pumped around the stator 31 through the flow path 34. The area of this flow path and, consequently, the flow rate of fluid through it, is defined and restricted by the outer diameter of the stator 31 and the inner diameter of the shell 20. As explained above, the inner diameter of the shell 20 is fixed for alignment purposes. As such, the flow path 34 defined by the stator 31 and the shell 20 is very narrow with a very small cross sectional area. It has been found that the performance characteristics of the pump-motor assembly 10 are severely degraded by the flow of fluid through such a restricted flow path 34.

Accordingly, there is a need for a pump-motor assembly that maintains alignment of its pump assembly components while providing greater fluid flow around a given diameter of the assembly's motor unit stator. Further, there is a need for a pump-motor assembly that achieves greater system flow rates and allows for maximizing dispensing capacity at a given required pressure.

SUMMARY OF THE INVENTION

According to one aspect of the present invention, a pump-motor assembly includes a motor unit, a pump assembly having components and a shell having an expanded portion in which the shell encloses the pump assembly components and the motor unit with the expanded portion disposed around the motor unit and in which the shell aligns the pump assembly components to the motor unit. The motor unit may include an end bell and a lead housing. The shell may contact the end bell, the lead housing or both. The motor unit may include a stator and, in such a case, the expanded portion of the shell may be disposed around the stator. The inner diameter of the expanded portion of the shell may be at least four inches.

According to another aspect of the present invention, a pump-manifold assembly includes a manifold, a pump-motor assembly and a piping assembly connecting the pump-motor assembly to the manifold. The pump-motor assembly includes a motor unit, a pump assembly having components and a shell having an expanded portion, wherein the shell encloses the pump assembly components and the motor unit with the expanded portion disposed around the motor unit and wherein the shell aligns the pump assembly components to the motor unit. The motor unit may include an end bell and a lead housing. The shell may contact the end bell, the lead housing or both. The motor unit may include a stator and, in such a case, the expanded portion of the shell may be disposed around the stator. The inner diameter of the expanded portion of the shell may be at least four inches.

According to a further aspect of the present invention, a petroleum distribution system for use in a petroleum dispensing station includes a petroleum storage tank; a petroleum dispenser; a pump-manifold assembly, in fluid communication with the petroleum dispenser, having a pump-motor assembly. The pump-motor assembly is disposed in the storage tank and the pump-motor assembly includes a motor unit, a pump assembly having components and a shell having an expanded portion, wherein the shell encloses the pump assembly components and the motor unit with the expanded portion disposed around the motor unit and wherein the shell aligns the pump assembly components to the motor unit. The motor unit may include an end bell and a lead housing. The shell may contact the end bell, the lead housing or both. The motor unit may include a stator and, in such a case, the expanded portion of the shell may be disposed around the stator. The inner diameter of the expanded portion of the shell may be at least four inches.

According to another aspect of the present invention, a method for increasing fluid dispensing flow rate in a petroleum distribution system for use in a petroleum dispensing station includes providing a petroleum distribution system including a petroleum storage tank; a petroleum dispenser; a pump-manifold assembly, in fluid communication with the petroleum dispenser, having a pump-motor assembly and energizing the pump-motor assembly to pressurize the petroleum distribution system. The pump-motor assembly is disposed in the storage tank and the pump-motor assembly includes a motor unit, a pump assembly having components, and a shell having an expanded portion, wherein the shell encloses the pump assembly components and the motor unit with the expanded portion disposed around the motor unit and wherein the shell aligns the pump assembly components to the motor unit.

According to another aspect of the present invention, a method for increasing dispensing capacity in a petroleum distribution system for use in a petroleum dispensing station where the maximum dispensing flow rate is capped includes providing a capped maximum dispensing flow rate; providing a petroleum distribution system including a petroleum storage tank; a petroleum dispenser; a pump-manifold assembly, in fluid communication with the petroleum dispenser, having a pump-motor assembly and energizing the pump-motor assembly to pressurize the petroleum distribution system. The pump-motor assembly is disposed in the storage tank and the pump-motor assembly includes a motor unit, a pump assembly having components, and a shell having an expanded portion, wherein the shell encloses the pump assembly components and the motor unit with the expanded portion disposed around the motor unit and wherein the shell aligns the pump assembly components to the motor unit. The provided capped maximum dispensing flow rate may be ten gallons per minute.

BRIEF DESCRIPTION OF THE DRAWING

These and other features, aspects, and advantages of the present invention will become better understood with regard to the following description and accompanying drawing where.

DETAILED DESCRIPTION OF THE INVENTION

Figure 1:
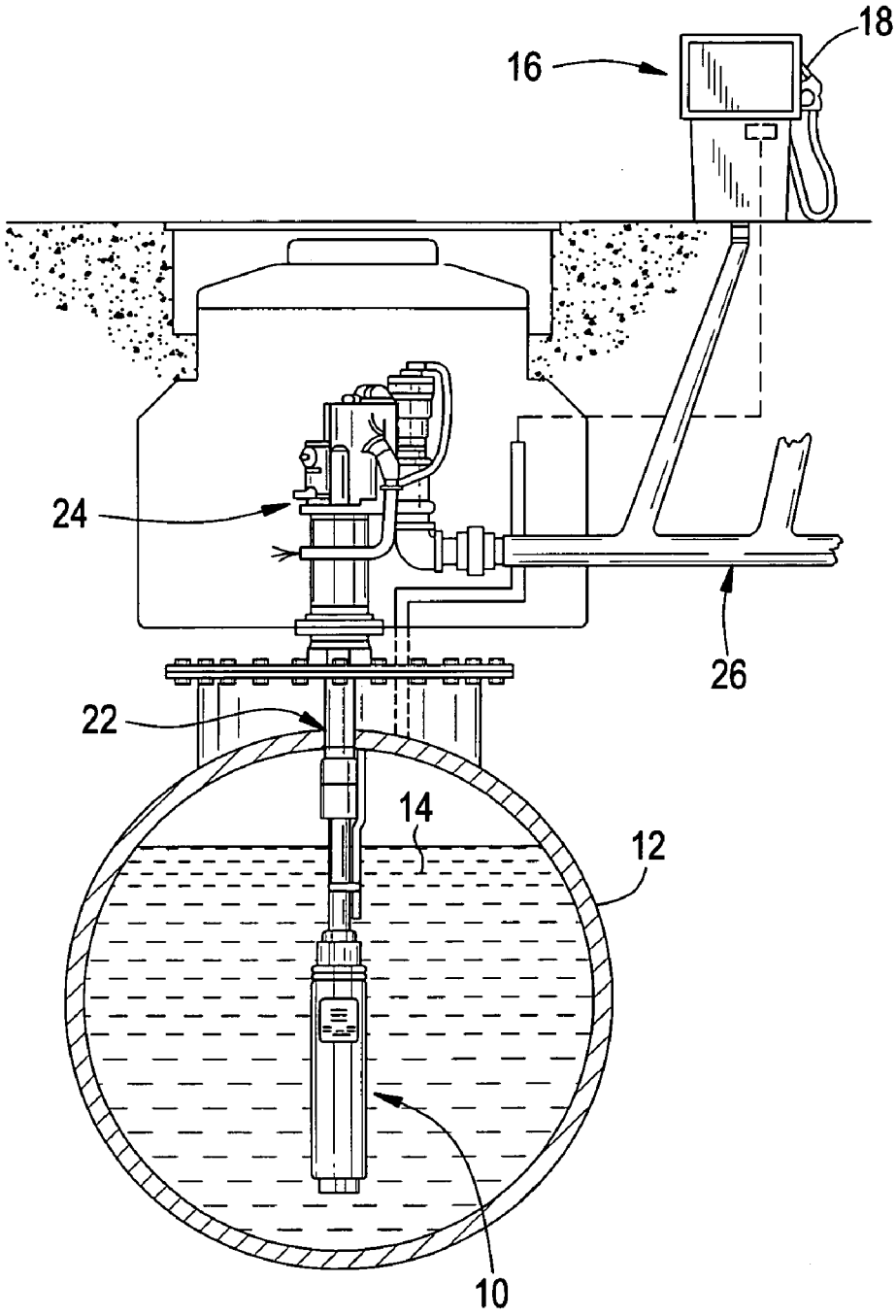
FIG. 1 PRIOR ART
FIG. 1 illustrates a petroleum distribution system incorporating a prior art pump-motor assembly.
Figure 3:
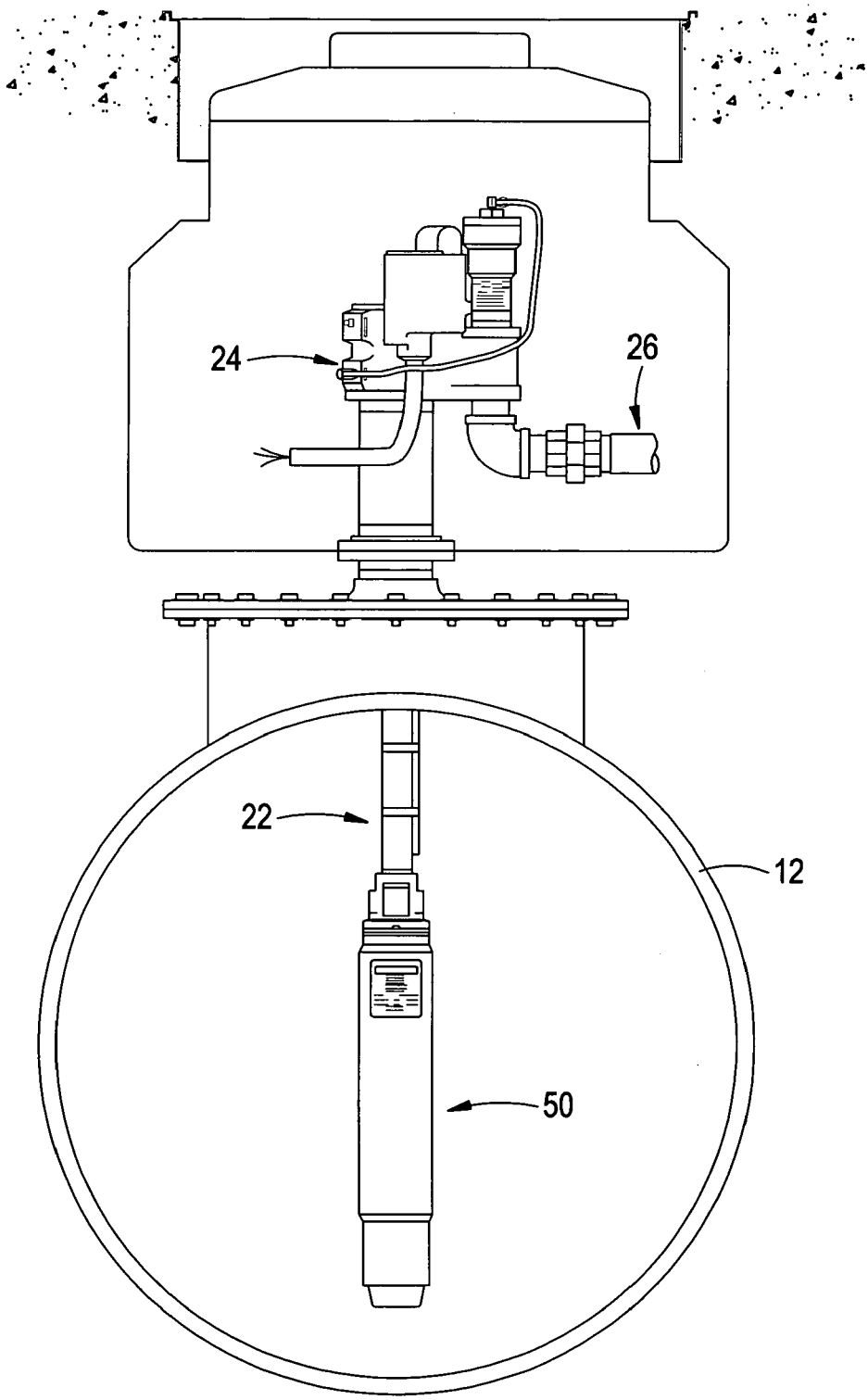
FIG. 3 illustrates a petroleum distribution system incorporating a pump-motor assembly of the present invention.
Figure 4:
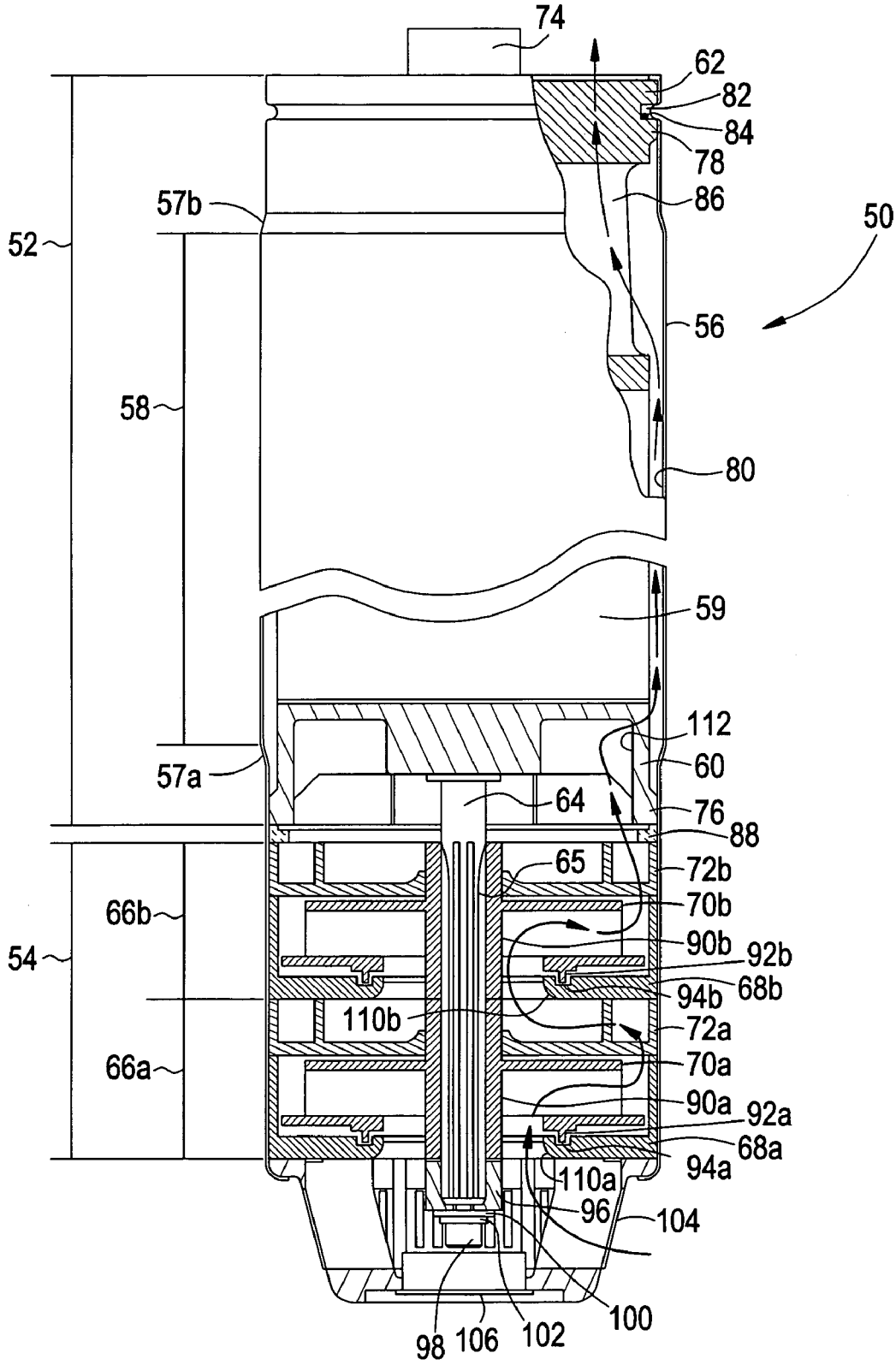
FIG. 4 is a partial sectional view of a pump-motor assembly of the present invention.

Referring to FIGS. 3 and 4, a pump-motor assembly 50 of the present invention for use in the petroleum distribution system of a petroleum dispensing station is illustrated. Referring to FIG. 3, the pump-motor assembly 50 is attached to the piping assembly 22 in the same or similar manner as pump-motor assembly 10 is attached to the piping assembly 22 in FIG. 1. Referring to FIG. 4, the pump-motor assembly 50 includes a motor unit 52 and a pump assembly 54 encased in a shell 56 having an expanded portion 58 between expansion points 57*a*, 57*b*. The motor unit 52 includes a stator 59, an end bell 60 attached to the stator 59 on the inlet side, a lead housing 62 attached to the stator 59 on the outlet side and a motor shaft 64 extending outward from the stator 59 and end bell 60. The motor unit 52 may be any type of sealed electric motor used in submersible turbine pump units. The pump assembly 54 is multi-stage and centrifugal in design. The pump assembly 54 depicted in the embodiment of FIG. 4 has two stages 66*a*, 66*b*, but it should be understood that any number of stages may be used. In this embodiment, each stage 66 includes a housing 68*a*, 68*b*; an impeller 70*a*, 70*b*; and a diffuser 72*a*, 72*b*. These components may be configured as necessary. For example, in this embodiment, the housings 68 and the diffusers 72 are separate components, but they could also be formed integral to one another in some form as well. In a preferred embodiment, the pump assembly components (i.e., the housing 68, the impeller 70 and the diffuser 72) may be made of any plastic, metal or other suitable material.

In this embodiment, the components of the pump-motor assembly 50 are typically assembled in the following manner. The motor unit 52 is inserted in the shell 56. In a preferred embodiment, the shell 56 is made from stainless steel but it may be made from any other suitable metal (e.g., aluminum, steel). Extending outward from the lead housing 62 is a motor plug 74 which connects to an electrical conduit disposed in the piping assembly 22 when the pump-motor assembly 50 is connected to the piping assembly 22. Further, in this embodiment, the motor unit 52 is designed such that the end bell 60 and the lead housing 62 have contact points 76, 78, respectively, and the outer diameter of each contact point 76, 78 is relatively equal to the inner diameter of the shell 56 such that when the motor unit 52 is inserted in the shell 56 the inner portion of the shell 56 at that point contacts the end bell 60 and the lead housing 62 at the contact points 76, 78. The contact points 76, 78 do not have to be integral with the end bell 60 and the lead housing 62 as shown in this embodiment. For instance, in other embodiments, the end bell 60 could have a larger diameter than the lead housing 62 in which case a spacer could be placed around the lead housing 62 to accommodate for the diameter differential between the shell 56 and the lead housing 62. The reverse, obviously, is also true. The lead housing 62 could have a larger diameter than the end bell 60 in which case a spacer could be placed around the end bell 60 to accommodate for the diameter differential between the shell 56 and the end bell 60.

The contact between the shell 56 and the contact points 76, 78 of the motor unit 52 acts to align the shell 56 with the stator 59 and motor shaft 64. As a result, the expanded portion 58 of the shell 56 is located between the two contact points 76, 78. The motor unit 52 and the shell 56 form an annular flow path 80 between them. The flow path 80 around the stator 59 is defined by the outer surface of the stator 59 and the inner surface of the expanded portion 58 of the shell 56. At the discharge end of the pump-motor assembly 50, the shell 56 is crimped in along an annular recess 82 in the lead housing 62, and a seal 84, an o-ring in this embodiment, is seated in the annular recess 82. The interaction between the shell 56, the lead housing 62 and the seal 84 acts to seal the outer edge of the motor unit 52 and keep fluid flowing through the flow path 80 directed inward through channels 86 formed in the lead housing 62.

With the motor unit 52 in place, the pump assembly 54 is assembled around the motor shaft 64. In differing embodiments, the design of the pump components could be in many forms and the assembly of such components could be accomplished in various ways. In this embodiment, the pump components, and their related assembly, are as described as follows. A spacer ring 88 is inserted the end bell 60 of the motor unit 52 and the upper diffuser 72*b*. The upper stage 66*b* of the pump assembly 54 has an impeller 70*b* with a spline hub 90*b*. Assembled, the diffuser 72*b* seats over the spline hub 90*b*, and the spline hub 90*b* is disposed over the motor shaft 64 and engages a spline 65 formed on the motor shaft 64. The housing 68*b* is disposed around the impeller 70*b*. The impeller 70*b* includes a seal extension 92*b* which interacts with a seal recess 94*b* formed in the housing 68*b* to form a dynamic seal between the impeller 70*b* and the housing 68*b* when the pump-motor assembly 50 is in operation. The components of the lower stage 66*a* of the pump assembly 54 are similar to those of the upper stage 66*b*. The outer diameters of the housings 68*a*, 68*b* and the diffusers 72*a*, 72*b* are relatively equal to the inner diameter of the shell 56 at that point. As such, the shell 56, which is aligned with the stator 59 via the contact points 60, 62, aligns the pump assembly components with the shaft 64 of the motor unit 52. The assembly of the pump assembly 54 is completed by inserting a shaft spacer 96 over the end of the motor shaft and locking the components in place with a socket head capscrew 98. A flat washer 100 and a lock washer 102 may be disposed between the shaft spacer 96 and the capscrew 98. Assembly of the pump-motor assembly 50 is completed by inserting an end bell 104 into the shell 56, abutting the lower stage housing 68*a*, and crimping the shell 56 around the end bell 104. A bottom plug 106 is inserted into the end bell 104 to complete the pump-motor assembly 50.

In operation, the motor unit 52 turns the motor shaft 64 which turns the pump impellers 70*a*, 70*b*. The pressure differential created by the impeller rotation draws fluid into the pump-motor assembly 50 through the end bell 104. Fluid drawn into the pump-motor assembly 50 generally follows the flow path indicated in FIG. 4. It should be understood that the flow through pump-motor assembly 50 is annular throughout the entire assembly and that the flow depicted is only through one side of the pump-motor assembly 50 for illustrative purposes. After passing through the end bell 104, the drawn-in fluid is pulled up through an opening 110*a* formed in the lower housing 68*a* into the rotating lower impeller 70*a*. From the lower impeller 70*a*, the fluid passes through the lower diffuser 72*a*. From the lower diffuser 72*a*, the fluid continues through the upper stage 66*b* in a similar manner. The energized fluid leaves the pump assembly 54 and is pushed through channels 112 in the end bell 60 into the flow path 80 between the stator 59 and the expanded shell portion 58. Once through the flow path 80, the fluid flows through the lead housing channels 86 out of the pump-motor assembly 50 into the piping assembly 22.

Figure 2:
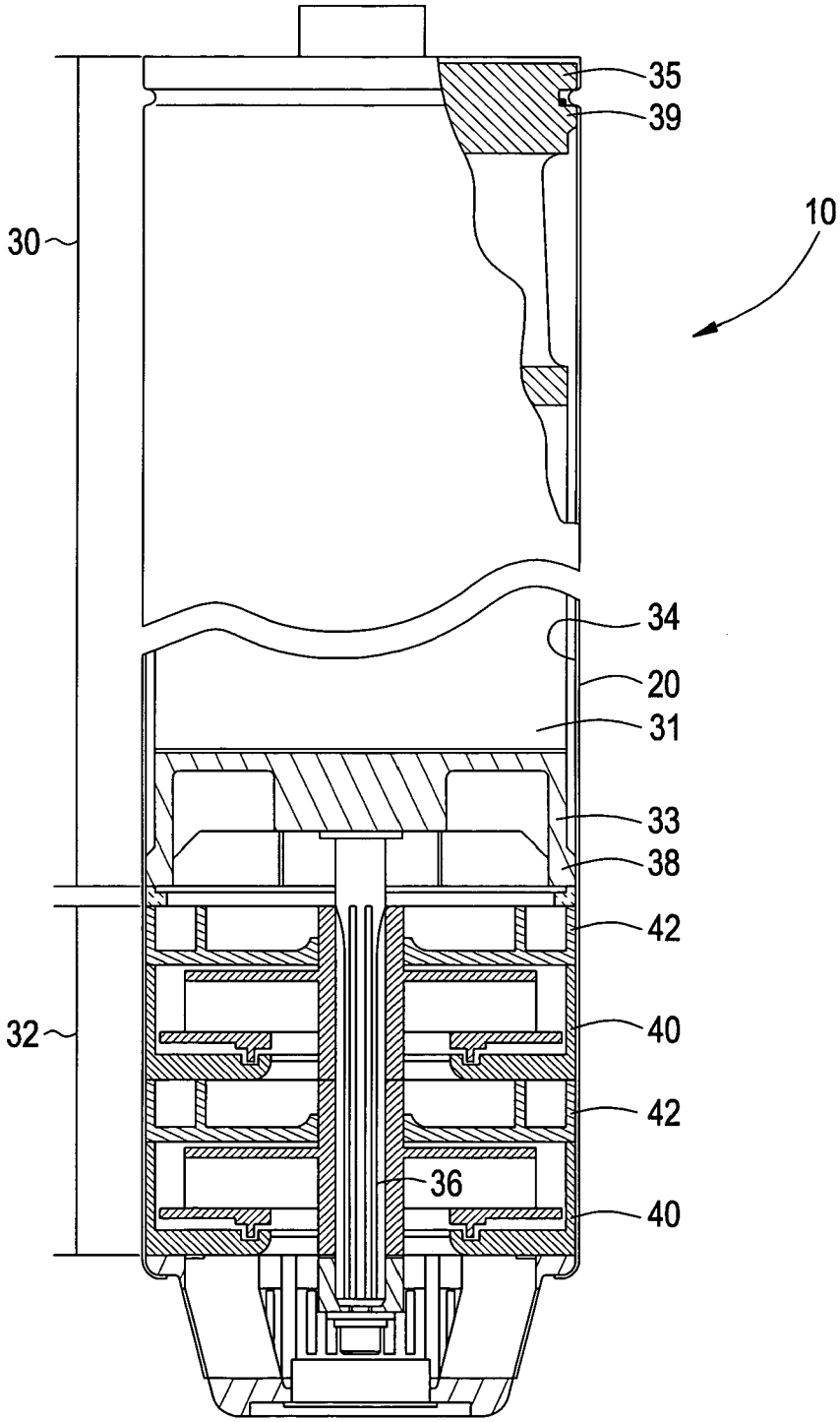
FIG. 2 PRIOR ART
FIG. 2 is a partial sectional view of a prior art pump-motor assembly.
Figure 5:
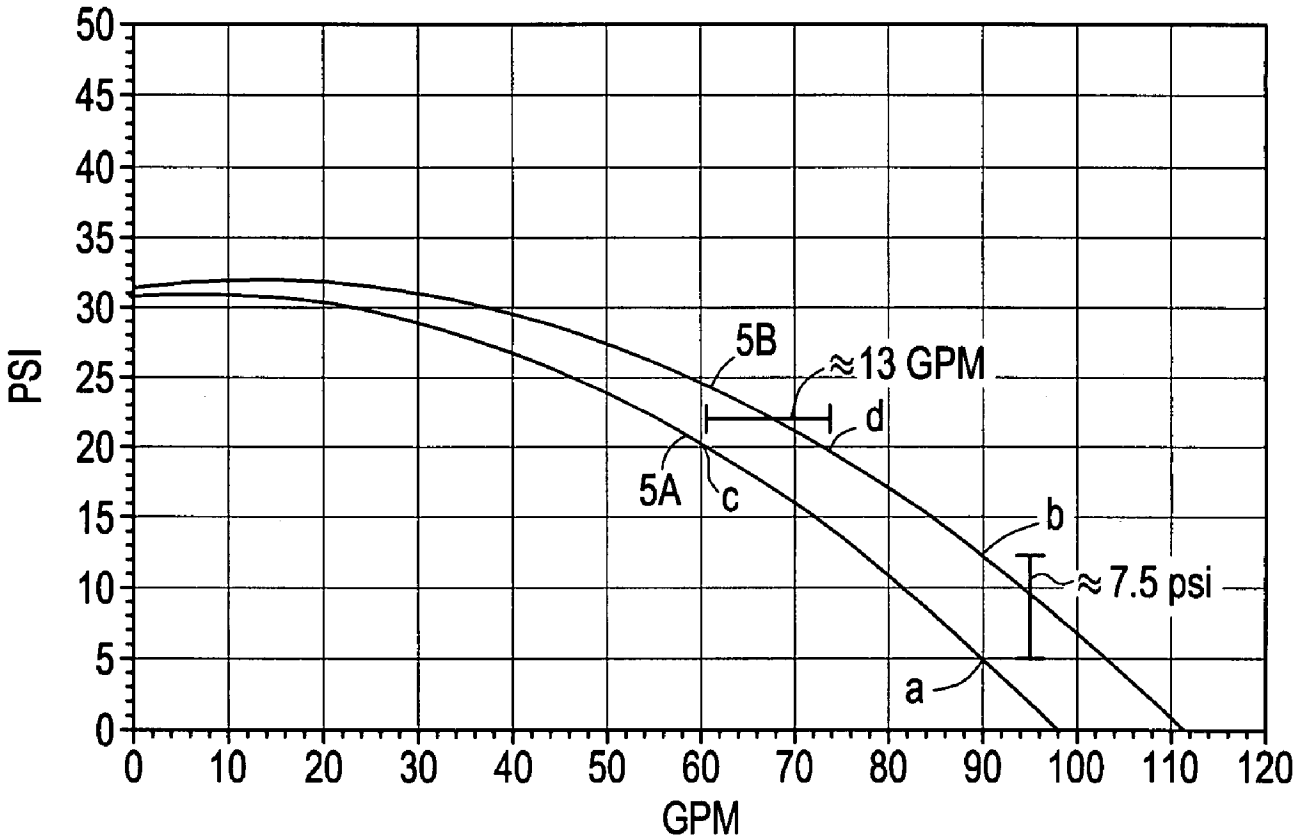
FIG. 5 illustrates the performance characteristics of a two stage pump-motor assembly of the present invention versus a two stage prior art pump-motor assembly.
Figure 6:
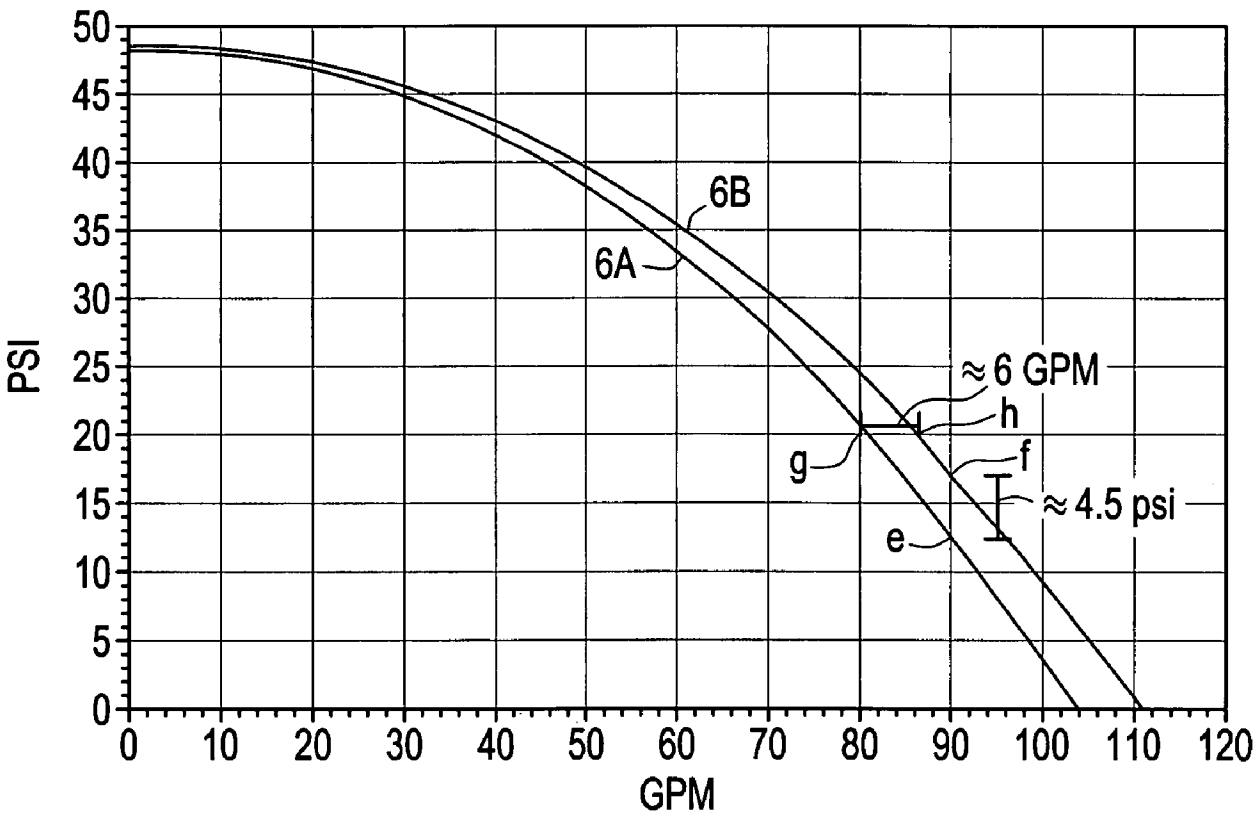
FIG. 6 illustrates the performance characteristics of a three stage/two diffuser pump-motor assembly of the present invention versus a three stage/two diffuser prior art pump-motor assembly.

FIGS. 5 and 6 illustrate the improved performance of pump-motor assemblies of the present invention versus prior pump-motor assemblies, such as pump-motor assembly 10 depicted in FIG. 2. Referring to FIG. 5, curve 5A is a pressure vs. flow curve for a pump-motor assembly with a straight shell and curve 5B is a pressure vs. flow curve for a pump-motor assembly of the present invention having an expanded shell. For this test data, both pump-motor assemblies used the same motor unit and pump assembly components. The motor unit was a 2 hp motor, and the assembly included two impellers and two diffusers. The stator outer diameter for both systems was 3.72 inches. The inner diameter of the shell for the straight shell assembly (curve 5A) was 3.916 inches, and the inner diameter of the shell at the expanded portion for the expanded shell assembly of the present invention (curve 5B) was 4.000 inches. As such, the annular flow area for the straight shell assembly was 1.175 $in^2$, and the annular flow area for the expanded shell assembly of the present invention was 1.698 $in^2$. The expanded shell assembly, therefore, provided an increased annular flow area of approximately 45% over the straight shell assembly.

Curves 5A and 5B show the system pressure loss as the flow rate through the system is increased. The system for these tests was the pumping system which includes the pump-motor assembly, the manifold and the piping assembly which connects the pump-motor assembly to the manifold. The improved performance characteristics of the expanded shell pump-motor assembly are most evident at higher flow rates. For instance, at a flow of 90 gallons/minute through the system, the system pressure in the system using the straight shell assembly is only 5 psi (point "a"), and the system pressure for the system using the expanded shell assembly is approximately 12.5 psi (point "b"). Therefore, the system using the expanded shell pump-motor assembly had 7.5 psi greater system pressure available due to less restriction through the pump-motor assembly 50 (i.e., the pressure drop across the stator 59 was reduced by 7.5 psi at 90 GPM).

From a dispensing station manager's perspective, such improved pump-motor assembly pumping characteristics ultimately means greater flow rates per dispenser or, when maximum flow rates are capped, potentially greater dispensing capacity. For instance, at a set system pressure, such as 20 psi (which is the typical dispensing pressure for a dispensing station dispenser), the system using the straight shell assembly (curve 5A) can only achieve a 60 GPM flow rate (point "c") while the system using the expanded shell assembly of the present invention (curve 5B) can achieve approximately a 73 GPM flow rate (point "d")—an approximate 13 GPM greater flow rate. Where the maximum dispensing flow rate is set or regulated for a particular product, such as the E.P.A.'s maximum regulated flow rate of 10 GPM per dispenser, the increased flow rate potential generated by pump-motor assembly 50 of the present invention translates into increased dispensing capacity for the dispensing station manager. For example, at a petroleum dispensing station with required dispensing pressure of 20 psi and a maximum dispenser flow rate of 10 GPM, a dispensing station manager using a prior art straight shell assembly can only use six (6) dispensers per pump-motor assembly. (Total Dispensers per Pump-Motor Assembly=Total Flow Rate+Maximum Flow Rate per Dispenser (i.e., 60 GPM/10 GPM=6 Dispensers)). On the other hand, a dispensing station manager using an expanded shell assembly of the present invention can use seven (7) dispensers per pump-motor assembly (i.e., 73 GPM/10 GPM=7.3 Dispensers).

This test data and similar results were also true for other pump configurations. Referring to FIG. 6, curve 6A is a pressure vs. flow curve for a pump-motor assembly with a straight shell and curve 6B is a pressure vs. flow curve for a pump-motor assembly of the present invention having an expanded shell. For this test data, both pump-motor assemblies used the same motor unit and pump assembly components as one another. The motor unit was a 2 hp motor, and the assemblies this time included three impellers and two diffusers. The motor stator and shell dimensions were the same for this test as they were for the test described above. The stator outer diameter for both systems was 3.72 inches. The inner diameter of the shell for the straight shell assembly (curve 6A) was 3.916 inches, and the inner diameter of the shell at the expanded portion for the expanded shell assembly of the present invention (curve 6B) was 4.000 inches. As with the assembly of the test described above, the annular flow area for the straight shell assembly was 1.175 $in^2$, and the annular flow area for the expanded shell assembly of the present invention was 1.698 $in^2$, giving the expanded shell assembly an increased annular flow area of approximately 45% over the straight shell assembly.

As with the graph described above, the curves 6A and 6B show the system pressure loss as the flow rate through the system is increased. The improved performance characteristics of the expanded shell pump-motor assembly are, once again, most evident at higher flow rates. For instance, at a flow rate of 90 GPM through the system, the system pressure in the system using the straight shell assembly was only about 12.5 psi (point "e"), and the system pressure for the system using the expanded shell assembly was approximately 17 psi (point "f"). Therefore, the system using the expanded shell pump-motor assembly had 4.5 psi greater system pressure available due to less restriction through the pump-motor assembly 50 (i.e., the pressure drop across the stator 59 was reduced by 4.5 psi at 90 GPM).

Again, from a dispensing station manager's perspective, such improved pump-motor assembly pumping characteristics ultimately means greater flow rates per dispenser or, when maximum flow rates are capped, potentially greater dispensing capacity. At the set pressure of 20 psi, the system using the straight shell assembly (curve 6A) can only achieve an approximate 80 GPM flow rate (point "g") while the system using the expanded shell assembly of the present invention (curve 6B) can achieve approximately a 86 GPM flow rate (point "h")—an approximate 6 GPM greater flow rate.

While the invention has been discussed in terms of certain embodiments, it should be appreciated by those of skill in the art that the invention is not so limited. The embodiments are explained herein by way of example, and there are numerous modifications, variations and other embodiments that may be employed that would still be within the scope of the present invention.

What is claimed is:

1. A submersible pump-motor assembly for pumping a fluid in which said pump-motor assembly is submersed, comprising:

a sealed motor unit including an end bell and a lead housing;

a pump assembly having components, said pump assembly having a predetermined cross-sectional area; and a shell having an expanded portion that is relatively larger than said predetermined cross-sectional area, wherein the shell encloses the pump assembly components and the motor unit, the expanded portion defining a cavity between said shell and said motor unit, wherein the shell, motor unit and pump assembly are configured to enable to the fluid in which said pump-motor assembly is immersed to be pumped through said cavity, said shell being further configured to align the pump assembly components to the motor unit, and wherein the shell contacts the end bell.

2. The pump-motor assembly of claim 1, wherein the shell contacts the lead housing.

3. The pump-motor assembly of claim 1, wherein the inner diameter of the expanded portion of the shell is at least four inches.

4. A pump-manifold assembly, comprising:

a manifold;

a pump-motor assembly; and a piping assembly connecting the pump-motor assembly to the manifold, wherein the pump-motor assembly comprises:

a sealed motor unit including an end bell and a lead housing;

a submersible pump assembly having components, said pump assembly configured to pump a fluid in which said pump-motor assembly is submersed, said pump assembly having a predetermined diameter; and a shell having an expanded portion relative to said pump assembly, wherein the shell encloses the pump assembly components and the motor unit and a cavity is defined in the expanded portion between said motor unit and said shell, wherein the shell, motor unit and pump assembly are configured to enable the fluid in which said pump is submersed to be pumped through said cavity, said shell further configured to align the pump assembly components to the motor unit, and wherein the shell contacts the lead housing.

5. The pump-manifold assembly of claim 4 wherein the shell contacts the end bell.

6. The pump-manifold assembly of claim 4, wherein the inner diameter of the expanded portion of the shell is at least four inches.

7. A petroleum distribution system for use in a petroleum dispensing station, comprising:

a petroleum storage tank;

a petroleum dispenser;

a pump-manifold assembly, in fluid communication with the petroleum dispenser, having a pump-motor assembly, wherein the pump-motor assembly is disposed in the storage tank and the pump-motor assembly comprises:

a sealed motor unit having an end bell and a lead housing;

a submersible pump assembly having components and having a predetermined diameter, said pump assembly configured to pump the fluid in which said pump assembly is submersed; and a shell having an expanded portion relative to said predetermined diameter, wherein the shell encloses the pump assembly components and the motor unit and the expanded portion defines a fluid cavity between the motor unit and the shell and wherein the shell, pump assembly and motor unit are configured to enable the fluid in which the pump is immersed to be pumped through said cavity, said shell further configured to align the pump assembly components to the motor unit, wherein the shell contacts the end bell and the lead housing.

8. The petroleum distribution system of claim 7, wherein the inner diameter of the expanded portion of the shell is at least four inches.

9. A method for increasing fluid dispensing flow rate in a petroleum distribution system for use in a petroleum dispensing station, comprising:

providing a petroleum distribution system including a petroleum storage tank; a petroleum dispenser; a pump-manifold assembly, in fluid communication with the petroleum dispenser, having a pump-motor assembly, wherein the pump-motor assembly is disposed in the storage tank and the pump-motor assembly includes a sealed motor unit which includes an end bell and a lead housing, a pump assembly having components and having a predetermined diameter, and a shell having an expanded portion relative to said predetermined diameter, wherein the shell encloses the pump assembly components and the motor unit and the expanded portion defines a fluid cavity between the motor unit and the shell and wherein the shell and said pump-motor assembly are configured to enable a fluid in which said pump-motor assembly is immersed to be pumped through said cavity, said shell further configured to align the pump assembly components to the motor unit, said shell and said motor unit being configured so that said shell contacts said end bell and said lead housing; and energizing the pump-motor assembly to pressurize the petroleum distribution system.

10. A method for increasing dispensing capacity in a petroleum distribution system for use in a petroleum dispensing station where the maximum dispensing flow rate is capped, comprising:

providing a capped maximum dispensing flow rate;

providing a petroleum distribution system including a petroleum storage tank; a petroleum dispenser; a pump-manifold assembly having a predetermined diameter, in fluid communication with the petroleum dispenser, having a pump-motor assembly, wherein the pump-motor assembly is disposed in the storage tank and the pump-motor assembly includes a sealed motor unit having an end bell and a lead housing, a pump assembly having components, and a shell having an expanded portion relatively larger than said predetermined diameter, wherein the shell encloses the pump assembly components and the sealed motor unit with the expanded portion disposed around the motor unit defining a cavity, wherein the shell and the pump-motor assembly are configured to enable a fluid in which said pump-motor assembly is immersed to be pumped through said cavity, said shell further configured to align the pump assembly components to the motor unit, said shell and said motor unit further configured so that said shell contacts said end bell and said lead housing; and energizing the pump-motor assembly to pressurize the petroleum distribution system.

11. The method of claim 10, wherein the provided capped maximum dispensing flow rate is ten gallons per minute.

* * * * *